US011460805B2

(12) United States Patent
Onishi

(10) Patent No.: US 11,460,805 B2
(45) Date of Patent: Oct. 4, 2022

(54) IMAGE FORMING APPARATUS WITH A COOLING FAN WHICH SUPPRESSES STICKING OF SHEETS

(71) Applicant: KYOCERA Document Solutions Inc., Osaka (JP)

(72) Inventor: Shota Onishi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/423,079

(22) PCT Filed: Dec. 11, 2019

(86) PCT No.: PCT/JP2019/048485
§ 371 (c)(1),
(2) Date: Jul. 14, 2021

(87) PCT Pub. No.: WO2020/149057
PCT Pub. Date: Jul. 23, 2020

(65) Prior Publication Data

US 2022/0082997 A1 Mar. 17, 2022

(30) Foreign Application Priority Data

Jan. 16, 2019 (JP) ..... JP2019-004932

(51) Int. Cl.
*G03G 21/00* (2006.01)
*G03G 21/20* (2006.01)
*G03G 15/00* (2006.01)

(52) U.S. Cl.
CPC ..... *G03G 21/206* (2013.01); *G03G 15/6552* (2013.01); *G03G 15/6573* (2013.01)

(58) Field of Classification Search
CPC ..... G03G 21/206; G03G 15/6552; G03G 15/6573; G03G 2215/00421;
(Continued)

(56) References Cited

U.S. PATENT DOCUMENTS

2006/0093420 A1* 5/2006 Oba ..... G03G 15/6573 399/405
2011/0081176 A1* 4/2011 Masuda ..... B65H 29/125 399/341
(Continued)

FOREIGN PATENT DOCUMENTS

JP H 9-34321 A 2/1997
JP 2002-82591 A 3/2002
(Continued)

*Primary Examiner* — Robert B Beatty
(74) *Attorney, Agent, or Firm* — Stein IP, LLC

(57) ABSTRACT

An image forming apparatus includes a fixing device, a discharge roller pair, a cooling fan, a detection portion, and a cooling fan control unit. The discharge roller pair discharges a sheet on which a toner image has been fixed in the fixing device to a discharge tray via a discharge port. The cooling fan cools the sheet discharged on the discharge tray by blowing air thereto. The detection portion detects a rear end of the sheet being conveyed from the fixing device toward the discharge port. The cooling fan control unit performs control so that, within a prescribed period from a point in time of detection of the rear end of the sheet by the detection portion to when the rear end passes through the discharge roller pair, a rotation speed of the cooling fan is reduced to be lower than a reference speed used to cool the sheet.

10 Claims, 11 Drawing Sheets

(58) Field of Classification Search
CPC ..... G03G 2221/1645; B41J 29/377; B65H 29/246; B65H 29/247
USPC ..... 399/92, 405
See application file for complete search history.

(56) References Cited

U.S. PATENT DOCUMENTS

| | | | | |
|---|---|---|---|---|
| 2012/0070215 | A1* | 3/2012 | Murakami | G03G 15/6573 399/92 |
| 2012/0093555 | A1* | 4/2012 | Obuchi | G03G 15/6552 399/405 |
| 2013/0094877 | A1* | 4/2013 | Tsuji | G03G 15/657 399/92 |
| 2018/0155146 | A1* | 6/2018 | Tokuma | B65H 31/38 |
| 2019/0382227 | A1* | 12/2019 | Sakagami | G03G 15/6552 |
| 2020/0156896 | A1* | 5/2020 | Tsuchiya | B65H 31/10 |
| 2020/0387102 | A1* | 12/2020 | Midorikawa | G03G 15/6552 |

FOREIGN PATENT DOCUMENTS

| | | | |
|---|---|---|---|
| JP | 2004-29471 | A | 1/2004 |
| JP | 2011-84359 | A | 4/2011 |
| JP | 2016-53609 | A | 4/2016 |

* cited by examiner

IMAGE FORMING APPARATUS WITH A COOLING FAN WHICH SUPPRESSES STICKING OF SHEETS

CROSS-REFERENCE TO RELATED APPLICATIONS

This application is a national stage of International Application No. PCT/JP2019/048485, filed Dec. 11, 2019, which claims the benefit of Japanese Application No. 2019-004932, filed Jan. 16, 2019, in the Japanese Patent Office, the disclosures of which are incorporated herein by reference.

TECHNICAL FIELD

The present invention relates to an image forming apparatus using an electrophotographic method, such as a copy machine, a printer, a facsimile, or a multi-functional peripheral having functions of these apparatuses.

BACKGROUND ART

In such an image forming apparatus using the electrophotographic method, toner is applied to an electrostatic latent image formed on an image carrier such as a photosensitive drum so that a toner image is formed thereon. Further, the toner image thus formed is transferred to a sheet such as a paper sheet, and then the toner image on the sheet is fixed by a fixing device.

Meanwhile, a sheet immediately after being subjected to fixing is in a heated state at a considerably high temperature. When the sheet after being subjected to fixing is discharged, without being sufficiently cooled, to a discharge tray and stacked thereon, re-fusion of toner might occur, causing stacked sheets to stick to each other. Furthermore, an attempt to peel off the mutually sticking sheets from each other might end up peeling off images as well from the sheets. As a solution to this, for example, in Patent Document 1, a sheet being discharged through a discharge port is cooled by air applied to both sides of the sheet, and thus sticking between sheets on a discharge tray is reduced.

LIST OF CITATIONS

Patent Literature

Patent Document 1: JP-A-H09-34321

SUMMARY OF INVENTION

Technical Problem

In the configuration of Patent Document 1, however, cooling air is constantly applied to a sheet being discharged through the discharge port, affecting the above-described sheet in such a way that the sheet is likely to lose its postural balance before reaching the discharge tray. This might result in sheets being stacked on the discharge tray in a disorganized manner, impairing an alignment property (stacking property) of the sheets.

Solution to Problem

An image forming apparatus according to one aspect of the present invention includes a fixing device that fixes a toner image on a sheet, a discharge roller pair that discharges the sheet on which the toner image has been fixed in the fixing device to a discharge tray via a discharge port, a cooling fan that cools the sheet discharged on the discharge tray by blowing air to the sheet, a detection portion that detects a rear end of the sheet being conveyed from the fixing device toward the discharge port, and a cooling fan control unit that, based on an amount of time that has elapsed from a point in time of detection of the rear end of the sheet by the detection portion, controls rotation of the cooling fan. The cooling fan control unit performs control so that, within a prescribed period from the point in time of detection of the rear end to when the rear end of the sheet passes through the discharge roller pair, a rotation speed of the cooling fan is reduced to a value lower than a reference speed used at a time of cooling the sheet.

Advantageous Effects of Invention

According to the above-described configuration, it is possible to suppress sticking between sheets on a discharge tray and image peeling resulting therefrom and also to reduce alignment failure of the sheets on the discharge tray.

DESCRIPTION OF EMBODIMENT

[Diagrammatic Configuration of Image Forming Apparatus]

Figure 1:
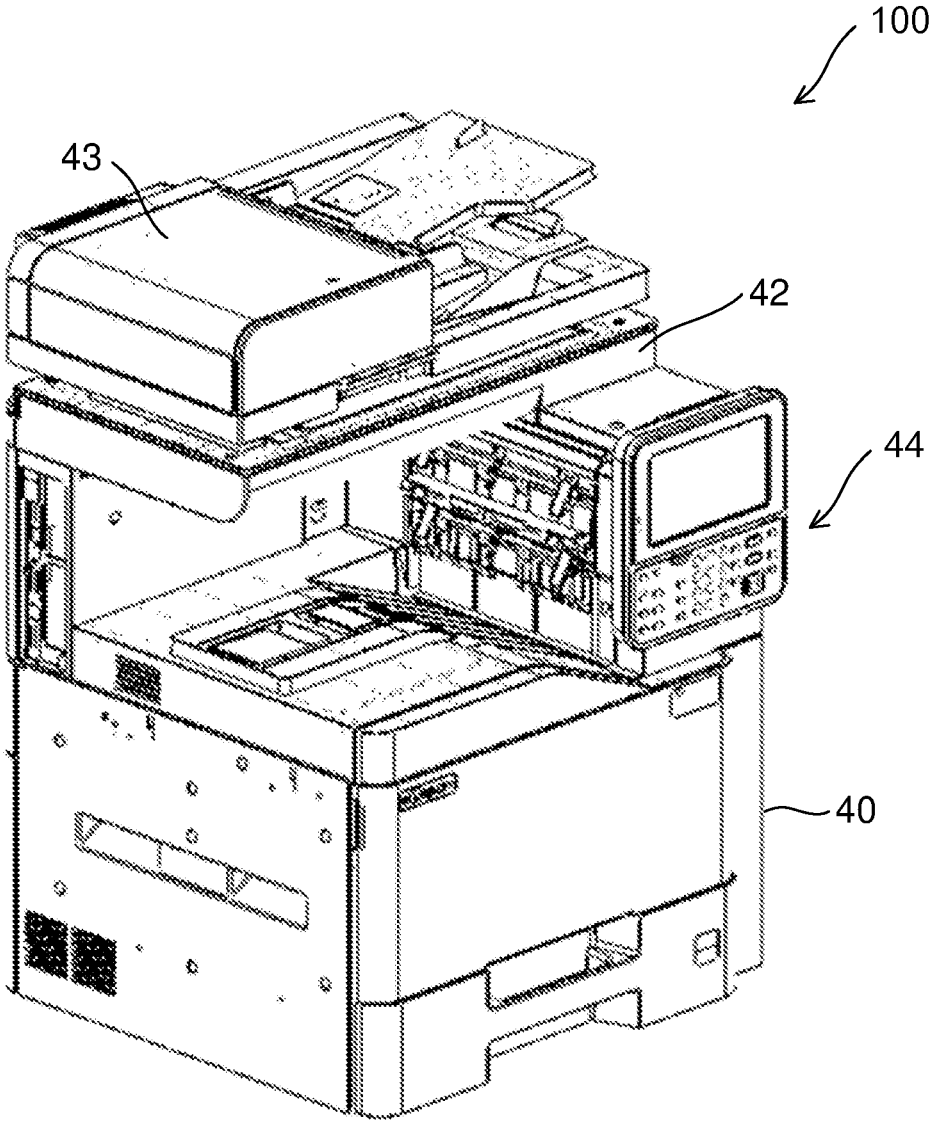
FIG. 1 is a perspective view showing an external configuration of an image forming apparatus according to one embodiment of the present invention.
Figure 2:
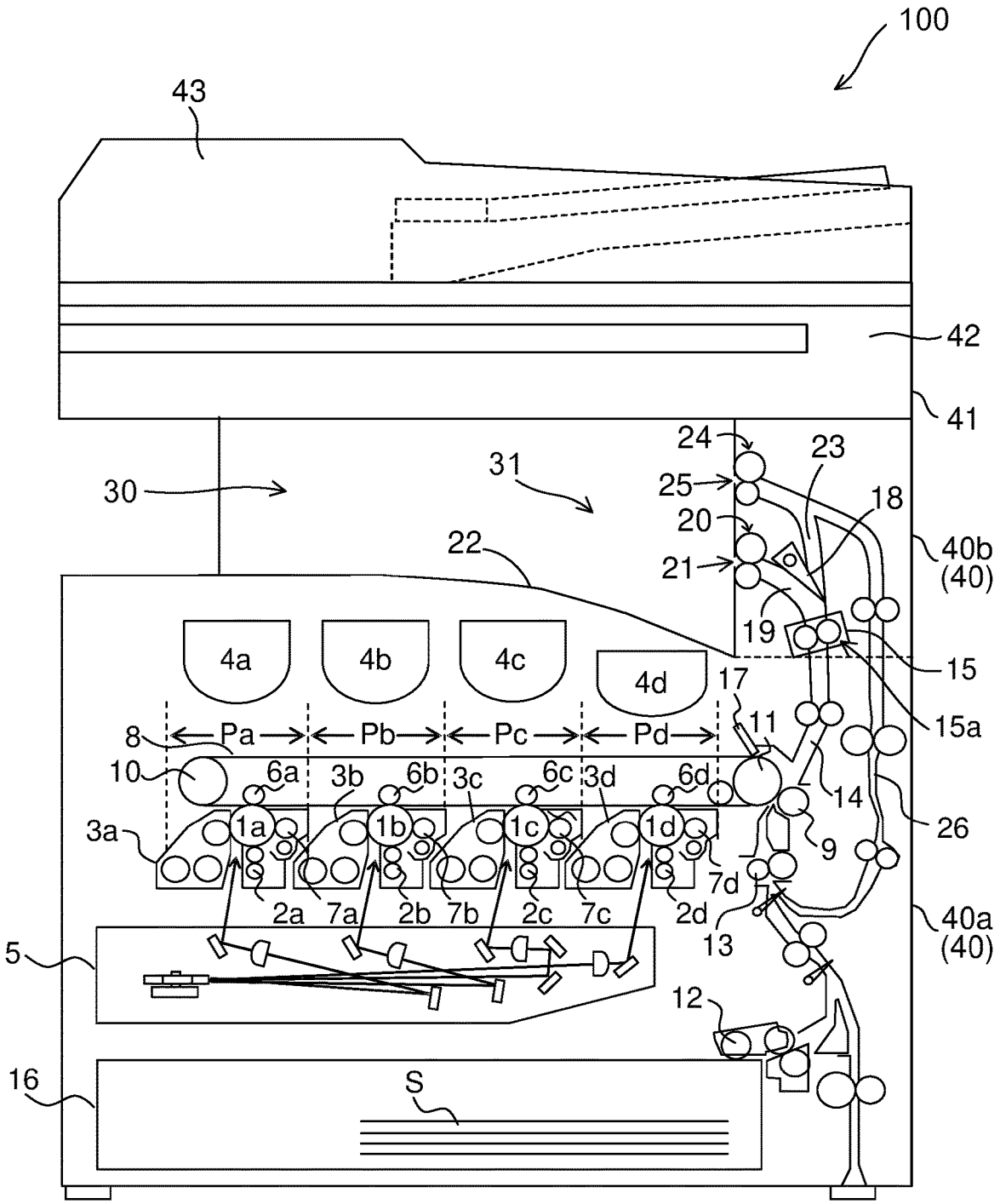
FIG. 2 is a sectional view schematically showing a diagrammatic configuration of the above-described image forming apparatus.

The present invention provides an image forming apparatus that can suppress sticking between sheets on a discharge tray and image peeling resulting therefrom and can also reduce alignment failure of the sheets on the discharge tray. The following describes an embodiment of the present invention with reference to the appended drawings. FIG. 1 is a perspective view showing an external configuration of an image forming apparatus 100 according to one embodiment of the present invention, and FIG. 2 is a sectional view schematically showing a diagrammatic configuration of the image forming apparatus 100. The image forming apparatus 100 is, for example, a tandem color copy machine of an intra-body paper discharge type. The image forming apparatus 100 is composed generally of a main body housing 40 and an upper housing 41 disposed above the main body housing 40.

An image reading portion 42 is provided in the upper housing 41. The image reading portion 42 is composed of a scanner lamp, a scanning optical system, a condenser lens, a CCD sensor, and so on (none of these are shown). The image reading portion 42 reads an image on an original document and converts it into image data. The scanner lamp illuminates the original document during copying. The scanning optical system is equipped with a mirror for changing an optical path of reflection light from the original document. The condenser lens condenses the reflection light from the original document so as to form the reflection light into an image. The CCD sensor converts image light thus formed into an electric signal.

In a case where an original document is to be read one by one by the image reading portion 42, an original document conveyance device 43 situated above the image reading portion 42 is opened. Then, the original document is placed on a contact glass provided on an upper surface of the upper housing 41. Furthermore, in a case where a bundle of original documents is to be automatically read by the image reading portion 42, the bundle of original documents is placed on a paper feed tray of the original document conveyance device 43 in a closed state. With this configuration, an original document is automatically fed, from the bundle of original documents, one by one onto the contact glass.

The main body housing 40 is composed of a lower housing 40*a* and a connection housing 40*b*. The connection housing 40*b* is situated above the lower housing 40*a* along a right side part in FIG. 2 and is connected to the upper housing 41. In the connection housing 40*b*, there is provided an operation panel 44 (see FIG. 1) that accepts a user's input for setting the number of copies to be made, the size of a sheet S, or the like. The connection housing 40*b* also constitutes a sheet discharge portion 31 where the sheet S on which printing has been performed is discharged on a discharge tray 22 situated at a bottom part of an intra-body discharge space 30. A paper sheet for copying, a postcard, an envelope, a transparent film, or the like in general use can be used as the sheet S.

The lower housing 40*a* includes image forming portions Pa to Pd, an exposure device 5, a paper feed cassette 16, and so on arranged therein. In the lower housing 40*a*, the four image forming portions Pa, Pb, Pc, and Pd are disposed in this order (in order from the left side in FIG. 2) along a travel direction of an intermediate transfer belt 8. The intermediate transfer belt 8 is driven by a driver (not shown) to travel counterclockwise in FIG. 2. The image forming portions Pa to Pd are provided so as to correspond to images of four different colors (cyan, magenta, yellow, and black) and each perform steps of charging, exposure, development, and transfer so that they sequentially form images of cyan, magenta, yellow, and black, respectively.

The image forming portions Pa to Pd respectively include photosensitive drums 1*a*, 1*b*, 1*c*, and 1*d* that are disposed therein to carry visible images (toner images) of the respective colors. The above-described intermediate transfer belt 8 is further provided adjacently to the image forming portions Pa to Pd. Toner images formed respectively on the photosensitive drums 1*a* to 1*d* are sequentially and primarily transferred so as to be superimposed on each other on the intermediate transfer belt 8 traveling in contact with the photosensitive drums 1*a* to 1*d*, and then are secondarily transferred on the sheet S by the action of a secondary transfer roller 9. The sheet S on which the toner images have been secondarily transferred is discharged, for example, on the discharge tray 22 after the toner images have been fixed in a fixing device 15. While the photosensitive drums 1*a* to 1*d* are being caused to rotate in a clockwise direction in FIG. 2, an image forming process with respect to each of the photosensitive drums 1*a* to 1*d* is performed.

The sheet S on which a toner image is to be transferred is housed in the paper feed cassette 16 in a lower part of a main body of the image forming apparatus 100. The above-described sheet S is conveyed to a nip between the secondary transfer roller 9 and an after-mentioned drive roller 11 of the intermediate transfer belt 8 via a paper feed roller 12 and a registration roller pair 13. As the intermediate transfer belt 8, a non-seamed (seamless) belt made of a dielectric resin sheet is mainly used. Furthermore, a blade-shaped belt cleaner 17 for removing residual toner or the like remaining on a surface of the intermediate transfer belt 8 is arranged on a downstream side of the secondary transfer roller 9.

Next, a description is given of the image forming portions Pa to Pd. Chargers 2*a*, 2*b*, 2*c*, and 2*d*, the exposure device 5, developing devices 3*a*, 3*b*, 3*c*, and 3*d*, and cleaning portions 7*a*, 7*b*, 7*c*, and 7*b* are provided around and below the photosensitive drums 1*a* to 1*d*, which are disposed rotatably. The chargers 2*a*, 2*b*, 2*c*, and 2*d* charge the photosensitive drums 1*a* to 1*d*, respectively. Based on image data, the exposure device 5 exposes each of the photosensitive drums 1*a* to 1*d* to light. The developing devices 3*a*, 3*b*, 3*c*, and 3*d* each form a toner image on a corresponding one of the photosensitive drums 1*a* to 1*d*. The cleaning portions 7*a*, 7*b*, 7*c*, and 7*d* remove residual developer (toner) or the like remaining on the photosensitive drums 1*a* to 1*d*, respectively.

In a case of performing a copy operation, in the image reading portion 42, an image on an original document is read and converted into image data. Then, surfaces of the photosensitive drums 1*a* to 1*d* are uniformly charged by the chargers 2*a* to 2*d*, respectively. Subsequently, by the exposure device 5, irradiation with light is performed based on the above-described image data so that an electrostatic latent image based on the above-described image data is formed on each of the photosensitive drums 1*a* to 1*d*. The developing devices 3*a* to 3*d* are each filled with a prescribed quantity of developer (for example, two-component developer) containing toner of a corresponding one of the respective colors of cyan, magenta, yellow, and black. In a case where, as a result of forming a toner image, the percentage of toner contained in the developer filled in the developing devices 3*a* to 3*d* falls below a set value, fresh toner is replenished from toner containers 4*a* to 4*d* to the developing devices 3*a* to 3*d*, respectively. The toner contained in the developer is supplied onto the photosensitive drums 1*a* to 1*d* by the developing devices 3*a* to 3*d*, respectively, and electrostatically adheres thereto, and thus a toner image based on the above-described electrostatic latent image is formed.

Then, a prescribed transfer voltage is applied to primary transfer rollers 6*a* to 6*d* so as to cause the toner images of yellow, cyan, magenta, and black on the photosensitive drums 1*a* to 1*d* to be primarily transferred on the intermediate transfer belt 8. These images of the four different colors are formed in a prescribed positional relationship predetermined for prescribed full-color image formation. After that, in preparation for subsequent formation of new electrostatic latent images, residual toner or the like remaining on the surfaces of the photosensitive drums 1*a* to 1*d* is removed by the cleaning portions 7*a* to 7*d*, respectively.

The intermediate transfer belt 8 is stretched between a tension roller 10 on an upstream side and the drive roller 11 on a downstream side. When the intermediate transfer belt 8 starts to rotate counterclockwise as the drive roller 11 is driven to rotate by a drive motor (not shown), the sheet S is conveyed at prescribed timing from the registration roller pair 13 to the nip (a secondary transfer nip) between the drive roller 11 and the secondary transfer roller 9 provided adjacently to the drive roller 11. Then, a full-color image on the intermediate transfer belt 8 is transferred on the sheet S. The sheet S on which the toner images have been transferred passes through a sheet conveyance path 14 to be conveyed to the fixing device 15.

The sheet S thus conveyed to the fixing device 15 is heated and pressed by a fixing roller pair 15*a*. This causes the toner images to be fixed on a surface of the sheet S, and thus a prescribed full-color image is formed thereon. In a case of performing printing only on one side of the sheet S, the above-described sheet S is guided to a first conveyance path 19 by a branch portion 18 and is discharged on the discharge tray 22 via a discharge port 21 by a discharge roller pair 20.

On the other hand, in a case of performing printing on both sides of the sheet S, the sheet S that has passed through the fixing device 15 is guided to a second conveyance path 23 by the branch portion 18. Then, a part of the sheet S is made to project once from a switchback roller pair 24 to the intra-body discharge space 30 via an opening 25. After that, the switchback roller pair 24 is caused to rotate reversely, thus effecting switchback of the sheet S, so that the sheet S is guided to a reverse conveyance path 26 and is conveyed, with an image surface thereof reversed, again to the secondary transfer nip via the registration roller pair 13. Then, by the secondary transfer roller 9, a subsequent image formed on the intermediate transfer belt 8 is transferred to a surface of the above-described sheet S on which no image has been formed. Further, the above-described sheet S is conveyed to the fixing device 15 where the toner image is fixed, and then passes through the first conveyance path 19 to be discharged on the discharge tray 22 by the discharge roller pair 20.

It is also possible that a user switches discharging of the sheet S by operating the operation panel 44 (see FIG. 1). For example, a configuration is possible in which the sheet S that has been subjected to normal image formation processing is discharged to the discharge tray 22 through the discharge port 21 by the discharge roller pair 20, while in a case of printing facsimile reception data or the like, the sheet S is discharged through the opening 25 by the switchback roller pair 24 (with no switchback of the sheet S performed). In this case, an auxiliary discharge tray (not shown) is installed over the discharge tray 22, and thus the sheet S discharged from the switchback roller pair 24 can be received by the auxiliary discharge tray so as to be separated from the sheet S discharged on the discharge tray 22 by the discharge roller pair 20.

[Supplementary Explanation of Sheet Discharge Portion]

Figure 3:
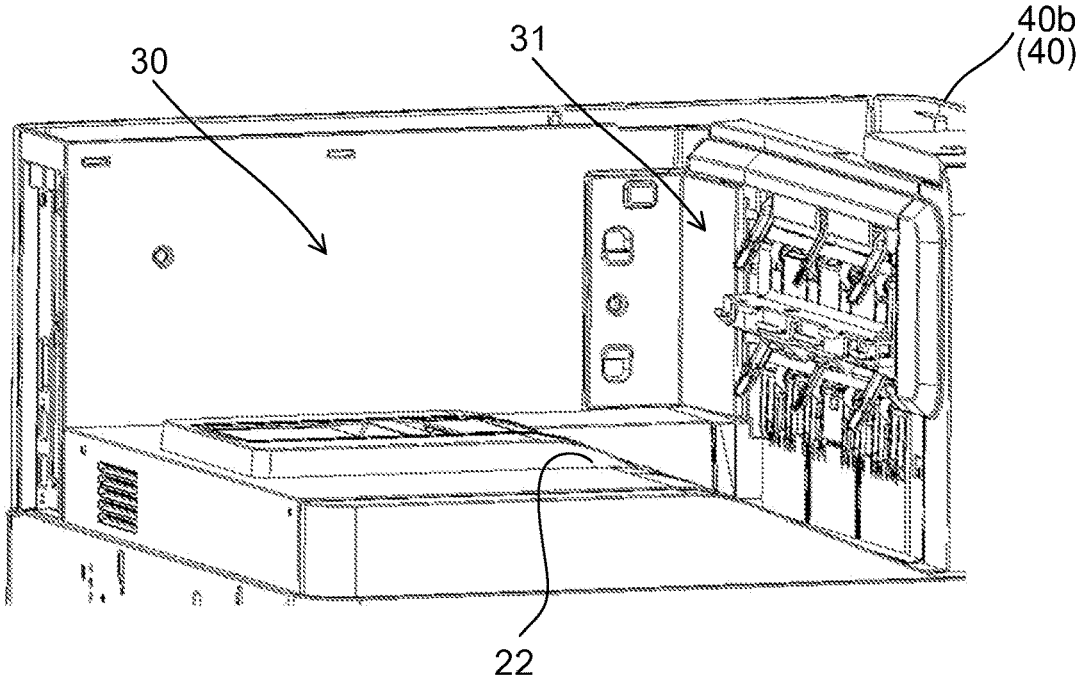
FIG. 3 is a perspective view showing an external appearance of a sheet discharge portion of the above-described image forming apparatus.
Figure 4:
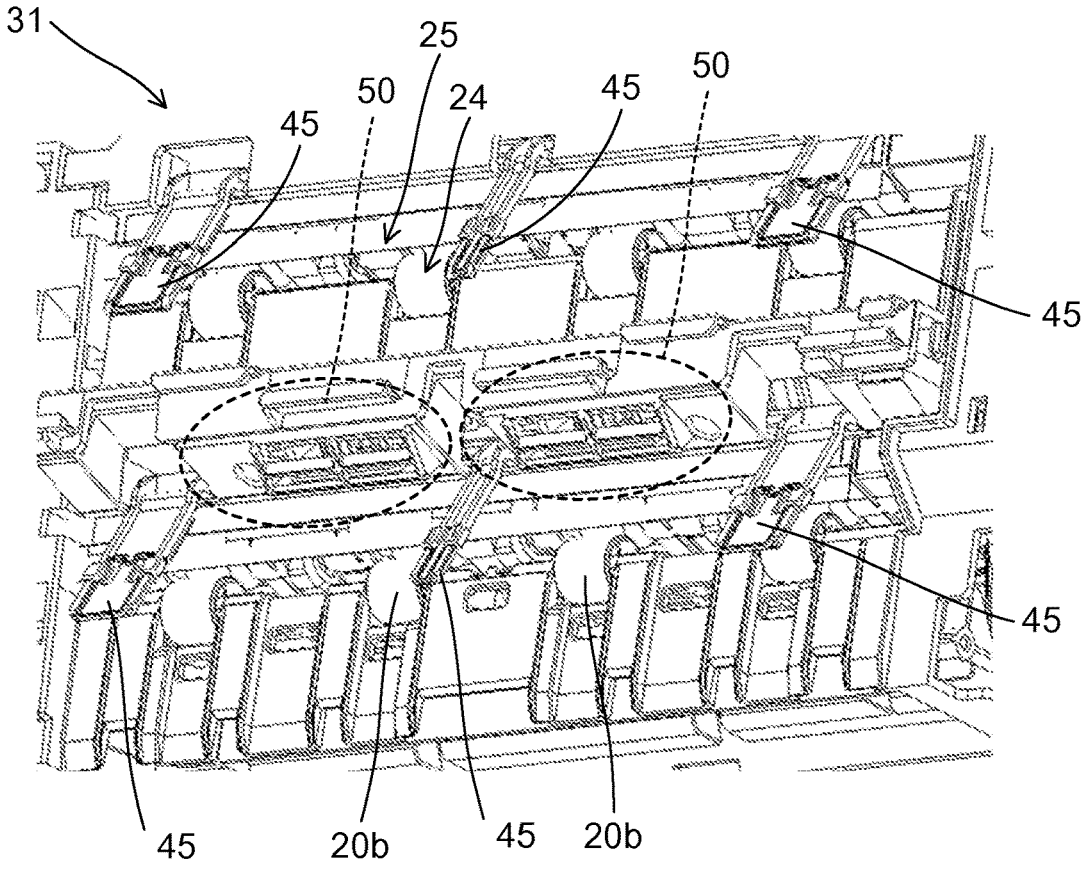
FIG. 4 is a perspective view showing, in an enlarged scale, the above-described sheet discharge portion.
Figure 5:
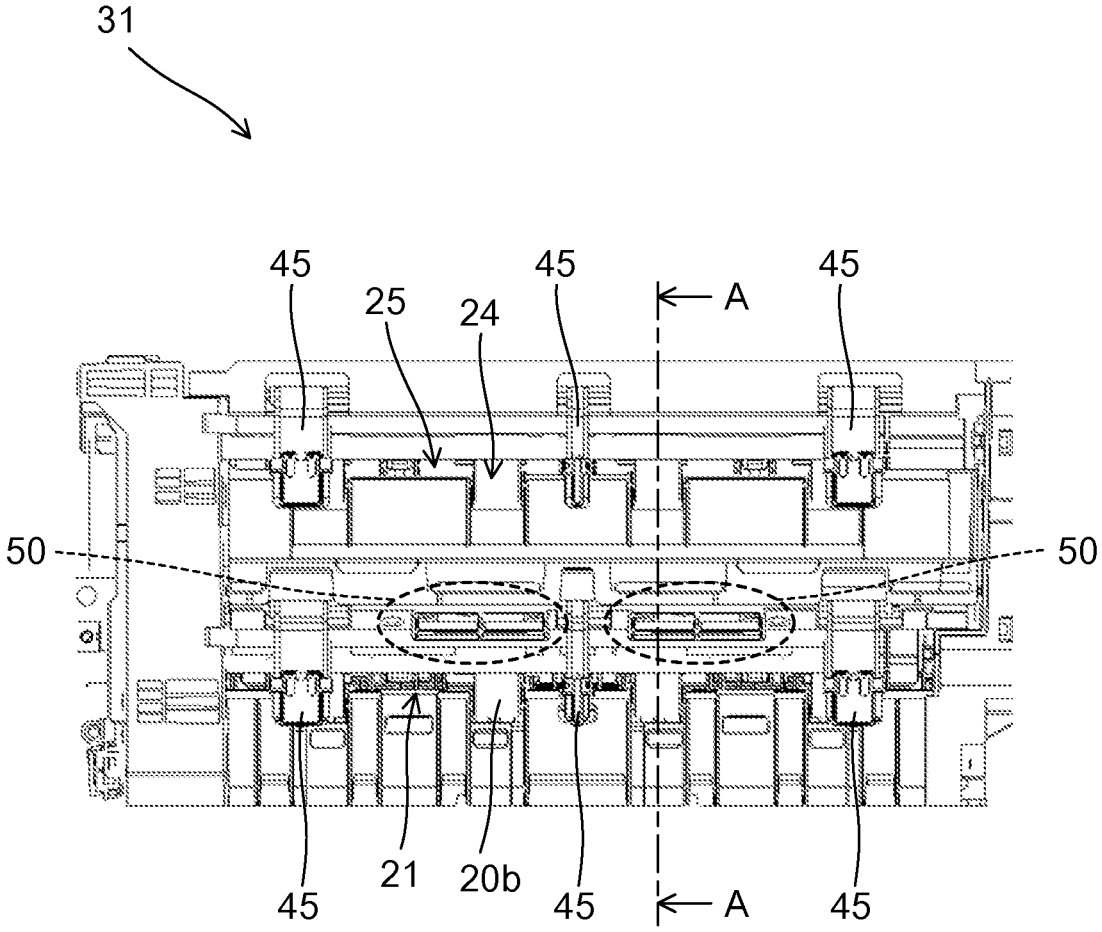
FIG. 5 is a left side view of the above-described sheet discharge portion.

Now, a supplementary explanation is given of the above-described sheet discharge portion 31. FIG. 3 is a perspective view showing an external appearance of the sheet discharge portion 31, and FIG. 4 is a perspective view showing, in an enlarged scale, the sheet discharge portion 31. Furthermore, FIG. 5 is a left side view of the sheet discharge portion 31, and FIG. 6 is a schematic sectional view of the sheet discharge portion 31 cut along a plane including a line A-A in FIG. 5.

The sheet discharge portion 31 has sheet contact pieces 45. The sheet contact pieces 45 are provided in upper and lower two rows so as to contact the sheet S being discharged through the discharge port 21 or the opening 25, thus preventing the sheet S from flying out. Among the sheet contact pieces 45, those in the first row are provided in the vicinity of the discharge port 21 respectively at three locations along a width direction of the sheet S, and those in the second row are provided in the vicinity of the opening 25 respectively at three locations along the width direction of the sheet S. The sheet contact pieces 45 in the first row are mounted to a turning shaft (not shown) extending along the width direction of the sheet S. The sheet contact pieces 45 in the second row are also mounted to a turning shaft (not shown) extending along the width direction of the sheet S. When contacted by the sheet S, the sheet contact pieces 45 each turn about a corresponding one of the turning shafts. Thus, it is possible, without interfering with discharging of the sheet S, to prevent the sheet S from flying out. This leads to improvement of an alignment property of the sheets S on the discharge tray 22.

Figure 6:
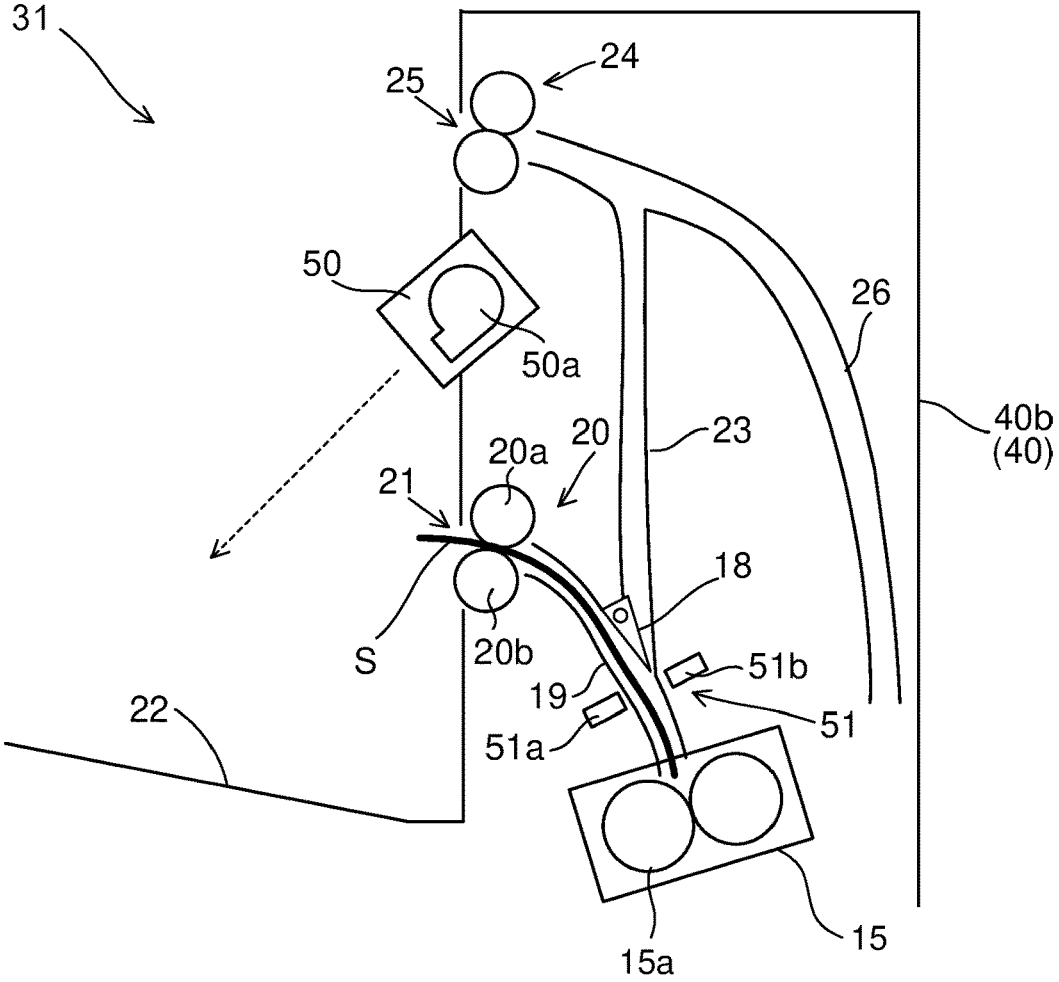
FIG. 6 is a schematic sectional view of the above-described sheet discharge portion cut along a plane including a line A-A in FIG. 5.

Furthermore, as shown in FIG. 6, the above-described discharge roller pair 20 in the sheet discharge portion 31 is composed of a discharge roller 20*a* and a discharge skid 20*b* that are arranged opposite to each other. The discharge roller 20*a* is a drive roller that is driven to rotate by a drive portion (not shown). The discharge skid 20*b* is a driven roller that rotates following rotation of the discharge roller 20*a*. The sheet S is conveyed between the discharge roller 20*a* and the discharge skid 20*b*, and in a state where the sheet S is held between these constituting the discharge roller pair 20, the discharge roller 20*a* is caused to rotate, and thus the sheet S can be discharged on the discharge tray 22 via the discharge port 21. While in this embodiment, relative to the sheet S, the discharge roller 20*a* is situated on an upper side and the discharge skid 20*b* is situated on a lower side, a positional relationship between them may be reversed.

Furthermore, the sheet discharge portion 31 has a cooling portion 50. The cooling portion 50 cools the sheet S discharged on the discharge tray 22 by the discharge roller pair 20. In this embodiment, the cooling portion 50 is formed of a cooling fan 50*a* (for example, a sirocco fan). The cooling fan 50*a* cools the sheet discharged on the discharge tray 22 by blowing air thereto. The cooling fan 50*a* is situated between the discharge port 21 and the opening 25 on a left side surface of the connection housing 40*b* and is set to blow air obliquely downward. Thus, cooling air can be applied to the sheet S on the discharge tray 22. While in this embodiment, as shown in FIG. 4 and FIG. 5, two cooling portions 50 (cooling fans 50*a*) are provided side by side in the width direction of the sheet S, there is no particular limitation on the number of cooling portions 50 used.

[Configuration of Control System for Cooling Fan]

Figure 7:
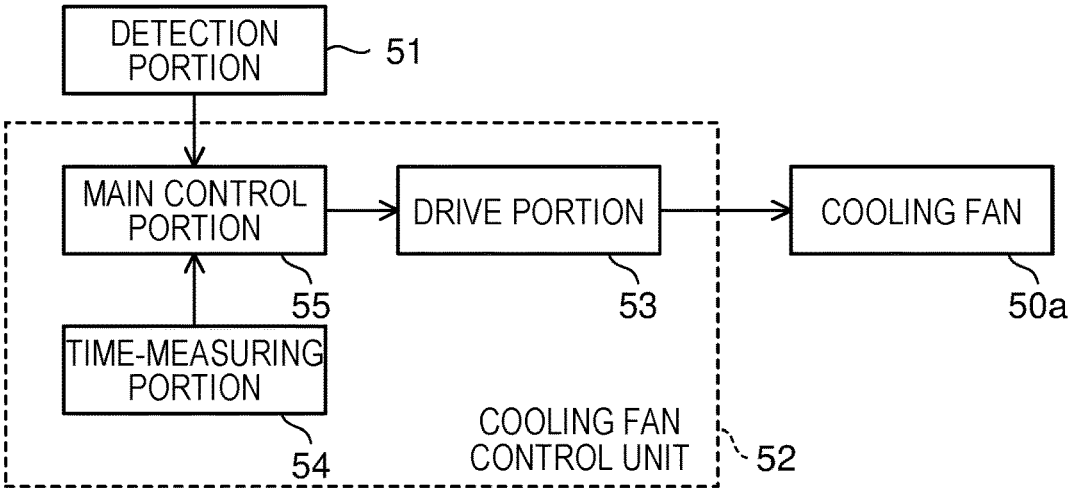
FIG. 7 is a block diagram schematically showing a configuration of a control system that controls rotation of a cooling fan in the above-described sheet discharge portion in the above-described image forming apparatus.

FIG. 7 is a block diagram schematically showing a configuration of a control system that controls rotation of the above-described cooling fan 50*a* in the image forming apparatus 100 according to this embodiment. The image forming apparatus 100 according to this embodiment further includes a detection portion 51 and a cooling fan control unit 52.

The detection portion 51 detects the sheet S being conveyed from the fixing device 15 toward the discharge port 21. Here, detecting the sheet S includes detecting a rear end of the sheet S and detecting a front end of the sheet S. The rear end of the sheet S refers to an end of the sheet S on a most upstream side in a conveyance direction of the sheet S being conveyed from the fixing device 15 toward the discharge port 21. Furthermore, the front end of the sheet S refers to an end of the sheet S on a most downstream side in the above-described conveyance direction of the sheet S.

The detection portion 51 is formed of a PI sensor (photo interrupter sensor) having a light-emitting element 51*a* and a light-receiving element 51*b* and detects, based on a reception state of light emitted from the light-emitting element 51*a* and received in the light-receiving element 51*b*, passage of the front and rear ends of the sheet S therethrough. For example, upon a change in the reception state of light received in the light-receiving element 51*b* from an ON state where light emitted from the light-emitting element 51*a* is receivable to an OFF state where the above-described light is not receivable, the detection portion 51 detects that the front end of the sheet S has passed therethrough. Furthermore, thereafter, upon a change in the reception state of light received in the light-receiving element 51 from the OFF state to the ON state, the detection portion 51 detects that the rear end of the sheet S has passed therethrough.

Based on an amount of time that has elapsed from a point in time of detection of the rear end of the sheet S by the detection portion 51, the cooling fan control unit 52 controls rotation of the cooling fan 50*a*. The cooling fan control unit 52 described as above is configured to have a drive portion 53, a time-measuring portion 54, and a main control portion 55. The drive portion 53 is a drive mechanism for causing the cooling fan 50*a* to rotate and is configured to include, for example, a motor, a gear, and so on. The time-measuring portion 54 is a timer that measures a time. The main control portion 55 is formed of, for example, a CPU (central processing unit) and controls operations of various portions of the image forming apparatus 100. Particularly, based on a result of detection in the detection portion 51 and an amount of time measured in the time-measuring portion 54, the main control portion 55 controls the drive portion 53.

[Rotation Control (1) of Cooling Fan]

Figure 8:
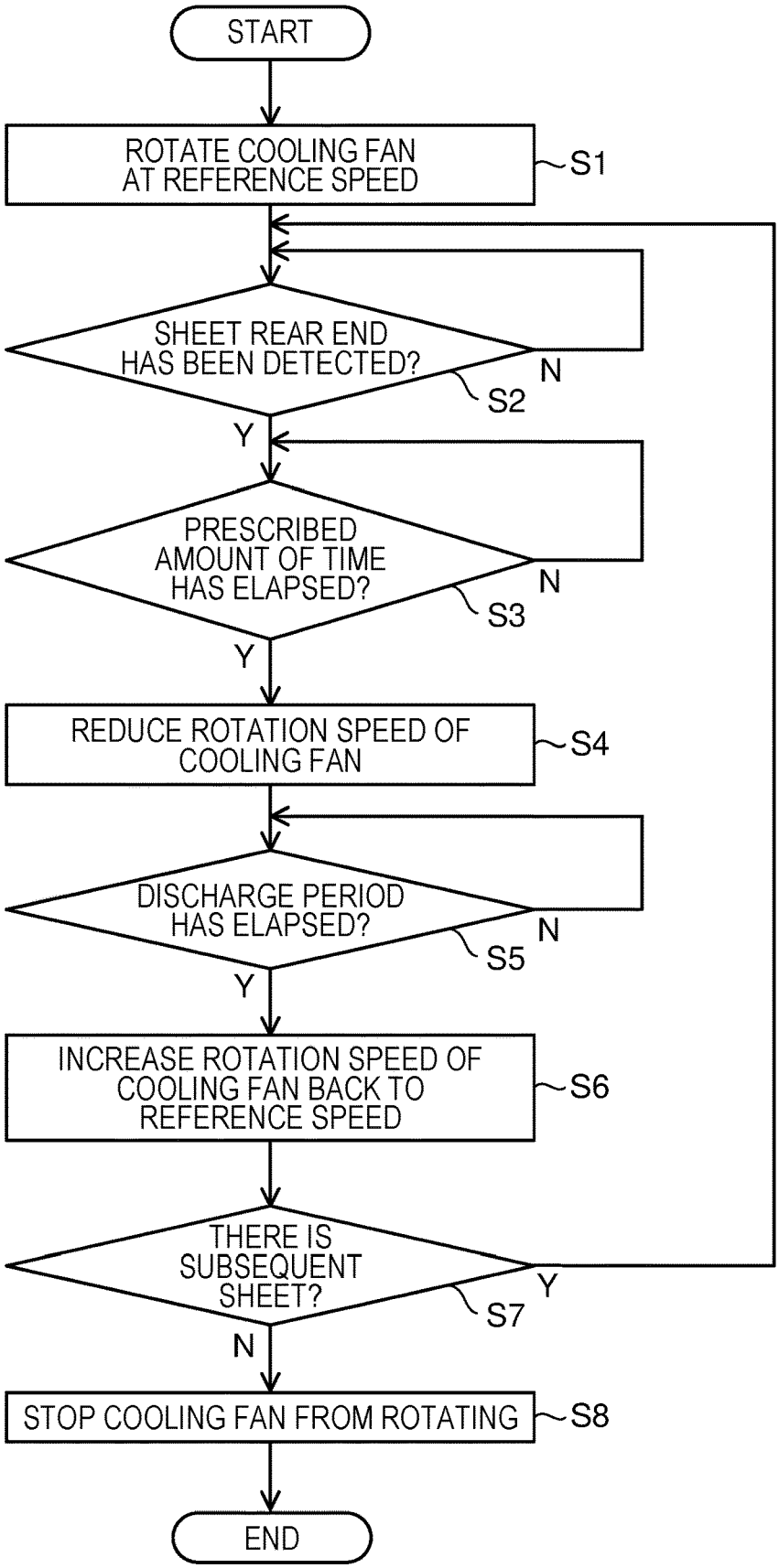
FIG. 8 is a flow chart showing a flow of rotation control of the above-described cooling fan.
Figure 9:
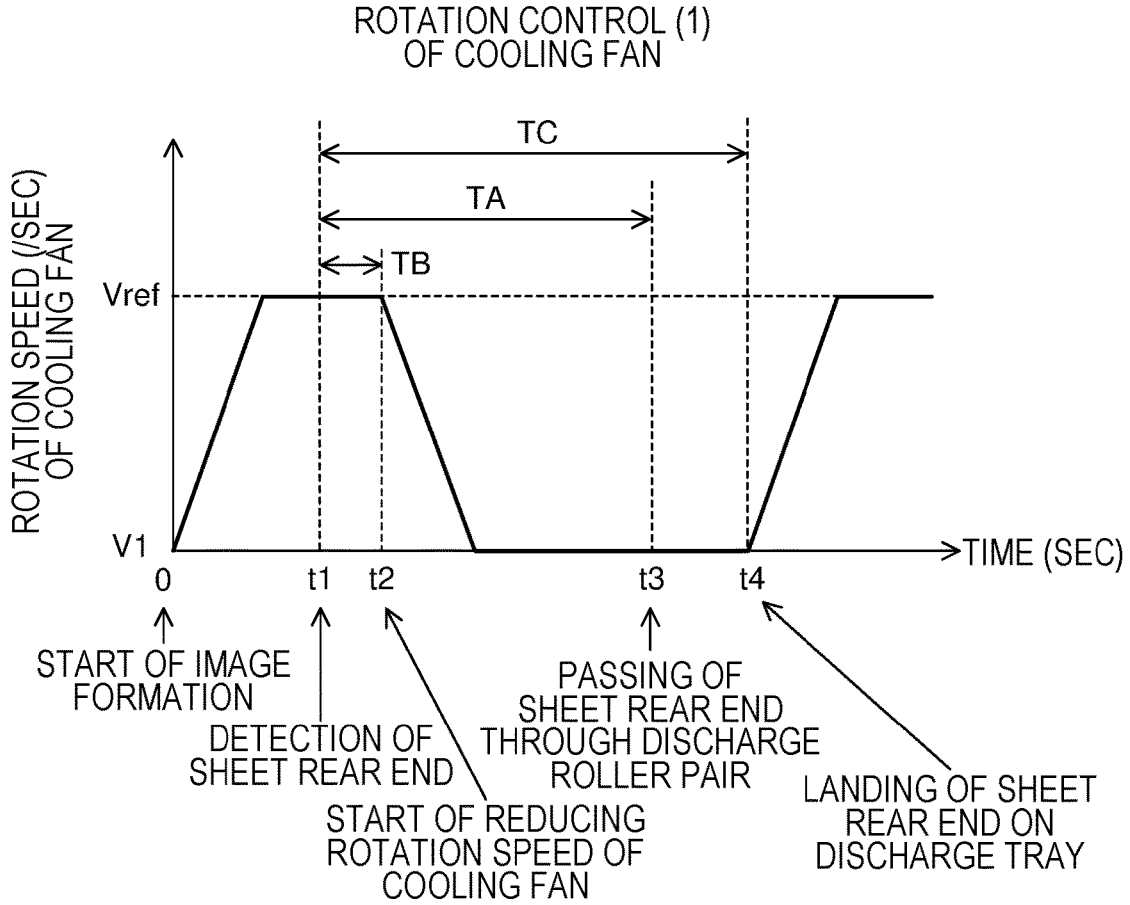
FIG. 9 is a graph showing one example of variations in rotation speed of the above-described cooling fan.

FIG. 8 is a flow chart showing a flow of rotation control of the cooling fan 50*a* according to this embodiment. Furthermore, FIG. 9 is a graph showing one example of variations in rotation speed of the cooling fan 50*a*. The following describes a specific procedure for rotation control of the cooling fan 50*a*.

First, when a start button is pressed on the operation panel 44 (see FIG. 1) to start an image forming operation in each of the image forming portions Pa to Pd, the cooling fan control unit 52 controls the cooling fan 50*a* to rotate at a reference speed Vref (/sec) (S1). The above-described reference speed Vref is defined as a rotation speed of the cooling fan 50*a* required for applying cooling air to the sheet S on the discharge tray 22. The cooling fan 50*a* rotates in this manner, and thus, for example, the sheet S discharged earlier on the discharge tray 22 in a previous job is cooled.

Figure 10:
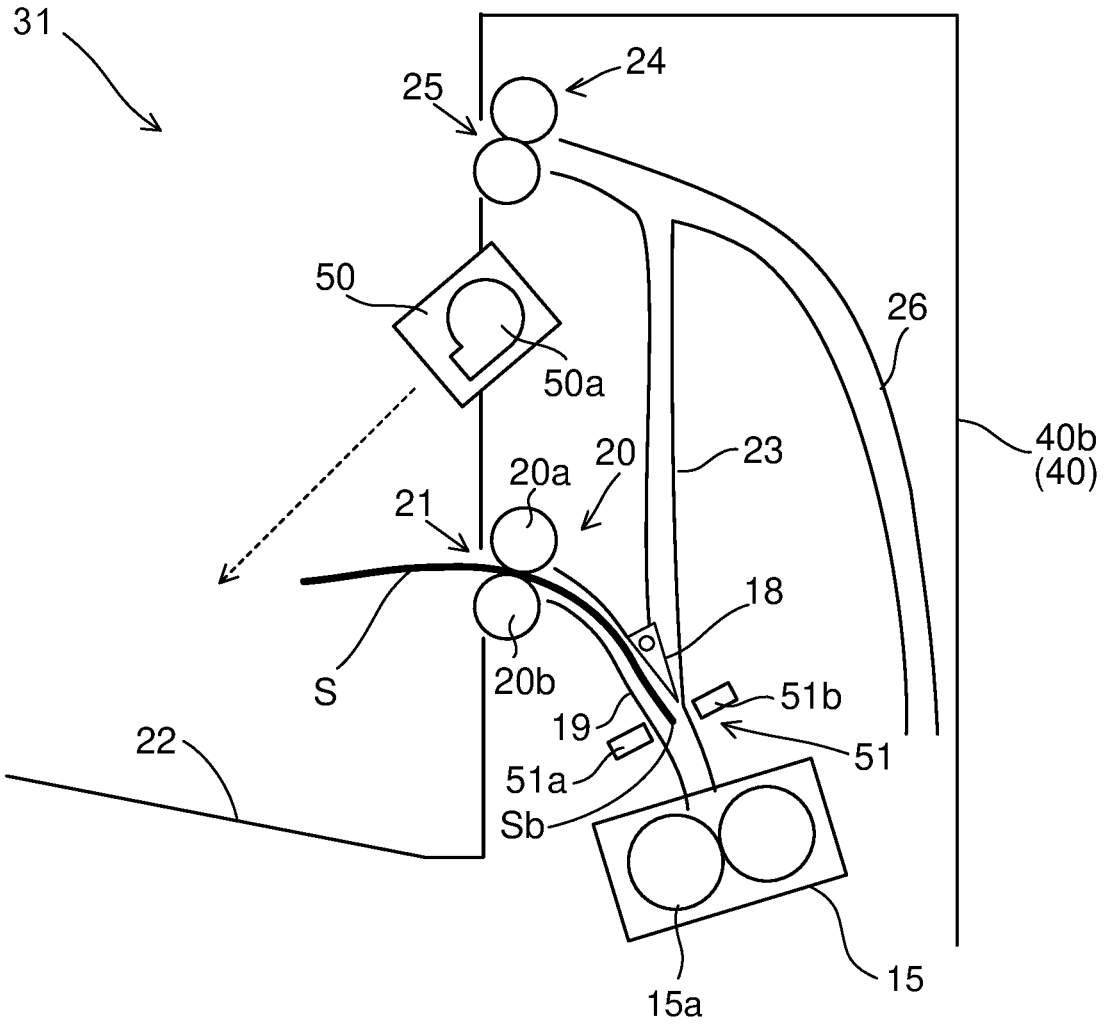
FIG. 10 is a sectional view schematically showing a state where a rear end of the above-described sheet has passed through a detection portion.

The sheet S on which toner images formed by the image forming portions Pa to Pd have been transferred is conveyed, as described above, to the fixing device 15 where the toner images are fixed, and then is discharged from the fixing device 15 (see FIG. 6). Then, as shown in FIG. 10, the detection portion 51 detects passage of a rear end Sb of the sheet S therethrough (S2), and at a lapse of a prescribed amount TB (sec) of time from a point in time of the detection (S3), the cooling fan control unit 52 performs control so that the rotation speed of the cooling fan 50*a* is reduced from the reference speed Vref used at the time of cooling the sheet S (S4). Herein, it is set that V1=0 where a value of the thus reduced rotation speed of the cooling fan 50*a* is indicated as V1 (/sec). That is, after a lapse of the prescribed amount TB of time from the point in time of detection of the rear end Sb of the sheet S, the cooling fan control unit 52 controls the cooling fan 50*a* to stop rotating. The point in time of detection of passage of the rear end Sb of the sheet S by the detection portion 51 is set to a point in time when t1 seconds elapse from a start point in time of image formation. Furthermore, a point in time when the prescribed amount TB of time elapses from the point in time of detection of the rear end Sb of the sheet S is set to a point in time when t2 seconds elapse from the start point in time of image formation.

The rotation speed of the cooling fan 50*a* may be reduced from the reference speed Vref at any timing falling within a prescribed period TA from a point t1 in time of detection of the rear end Sb of the sheet S by the detection portion 51 to when the rear end Sb of the sheet S passes through the discharge roller pair 20. Accordingly, the above-described prescribed amount TB of time can also be set to 0 (sec) (may be set so that t1=t2). A point in time of passage of the rear end Sb of the sheet S through the discharge roller pair 20 is set to a point in time when t3 seconds elapse from the start point in time of image formation.

Here, the above-described prescribed period TA can be determined as follows. That is, a conveyance distance of the sheet S from a position at which the rear end Sb of the sheet S is detected by the detection portion 51 to the position of the discharge roller pair 20 is predetermined in apparatus designing. Furthermore, a discharge speed of the sheet S is equal to a rotation speed (circumferential speed) of the discharge roller 20*a*, which is known beforehand. Accordingly, the cooling fan control unit 52 can determine the above-described prescribed period TA by dividing the above-described conveyance distance of the sheet S by the discharge speed of the sheet S (the rotation speed of the discharge roller 20*a*). The above-described prescribed period TA may have a preset value.

Next, the cooling fan control unit 52 determines whether or not a discharge period TC from the point t1 in time of detection of the rear end Sb of the sheet S by the detection portion 51 to when the rear end Sb of the sheet S lands on the discharge tray 22 has elapsed (S5). The discharge period TC is set to be a predetermined period. Furthermore, a point in time when the discharge period TC elapses is set to a point in time when t4 seconds elapse from a start of image formation. Upon determining at S5 that the discharge period TC has elapsed, the cooling fan control unit 52 performs control so that the rotation speed of the cooling fan 50*a* is increased back to the reference speed Vref as an original value (S6). Thus, the sheet S that has landed on the discharge tray 22 is cooled.

Subsequently, the cooling fan control unit 52 determines whether or not passage of a front end of a subsequent sheet S has been detected by the detection portion 51 (S7), and when no such detection has been made, determining that there is no subsequent sheet S, the cooling fan control unit 52 controls the cooling fan 50*a* to stop rotating (S8), thus ending a series of control steps. On the other hand, in a case where passage of the front end of the subsequent sheet S has been detected by the detection portion 51 at S7, a return is made to S2 so that control steps similar to the above are repeatedly performed.

As described above, the cooling fan 50*a* blows air, in other words, the cooling fan 50*a* rotates at the reference speed Vref (/sec), and thus the sheet S discharged on the discharge tray 22 via the discharge port 21 from the fixing device 15 is cooled (S1, S6). Thus, it is possible to reduce occurrence of re-fusion of toner on the above-described sheet S on the discharge tray 22 so as to suppress sticking between the sheets S loaded on the discharge tray 22 and image peeling resulting therefrom.

Furthermore, within the prescribed period TA from the point in time of detection of the rear end Sb of the sheet S to when the rear end Sb of the sheet S passes through the discharge roller pair 20, the cooling fan control unit 52 performs control so that the rotation speed of the cooling fan 50*a* is reduced to a value lower than the reference speed Vref used at the time of sheet cooling (S4). Thus, it is possible to suppress a phenomenon in which, after the rear end Sb of the sheet S has passed through the discharge roller pair 20 and before it lands on the discharge tray 22, the sheet S loses its postural balance due to air blown from the cooling fan 50*a*. Accordingly, it is possible to load the sheets S on the discharge tray 22 so that an excellent alignment property is achieved, thus reducing alignment failure.

Furthermore, within the prescribed period TA and at timing (timing t2) later than the point t1 in time of detection of the rear end Sb of the sheet S, the cooling fan control unit 52 performs control so that the rotation speed of the cooling fan 50*a* is reduced to a value lower than the reference speed Vref (S2 to S4). In this case, the cooling fan 50*a* can be kept rotating at the reference speed Vref as long as possible. Accordingly, it is possible to sufficiently obtain an effect of cooling the sheet S discharged earlier on the discharge tray 22, thus reliably suppressing above-described issues, i.e., sticking between the sheets S and image peeling therefrom.

Furthermore, within the prescribed period TA, the cooling fan control unit 52 controls the cooling fan 50*a* to stop rotating (S4). In this case, after the rear end Sb of the sheet S has passed through the discharge roller pair 20, in no case does the sheet S receive air blown from the cooling fan 50*a*, and thus the sheet S lands on the discharge tray 22 without losing its postural balance. Thus, it is possible to reliably reduce alignment failure of the sheets S on the discharge tray 22.

Furthermore, the above-described prescribed period TA is a duration determined based on a predetermined sheet conveyance distance from a position at which the rear end Sb of the sheet S is detected by the detection portion 51 to the position of the discharge roller pair 20 and the discharge speed of the sheet S discharged by the discharge roller pair 20. The prescribed period TA is determined based on the conveyance distance and discharge speed of the sheet S as described above, and thus it is possible to reliably perform the control according to this embodiment in which, within the prescribed period TA, the rotation speed of the cooling fan 50*a* is reduced to a value lower than the reference speed Vref.

Furthermore, after a lapse of the discharge period TC, the cooling fan control unit 52 performs control so that the rotation speed of the cooling fan 50*a* is increased back to the reference speed Vref. In this case, even in continuous printing, a preceding sheet S that has landed on the discharge tray 22 can be cooled by the cooling fan 50*a* rotating at the above-described reference speed Vref. Accordingly, it is possible to suppress sticking between the preceding sheet S and a subsequent sheet S discharged next on the discharge tray 22 and image peeling from them.

[Rotation Control (2) of Cooling Fan]

Figure 11:
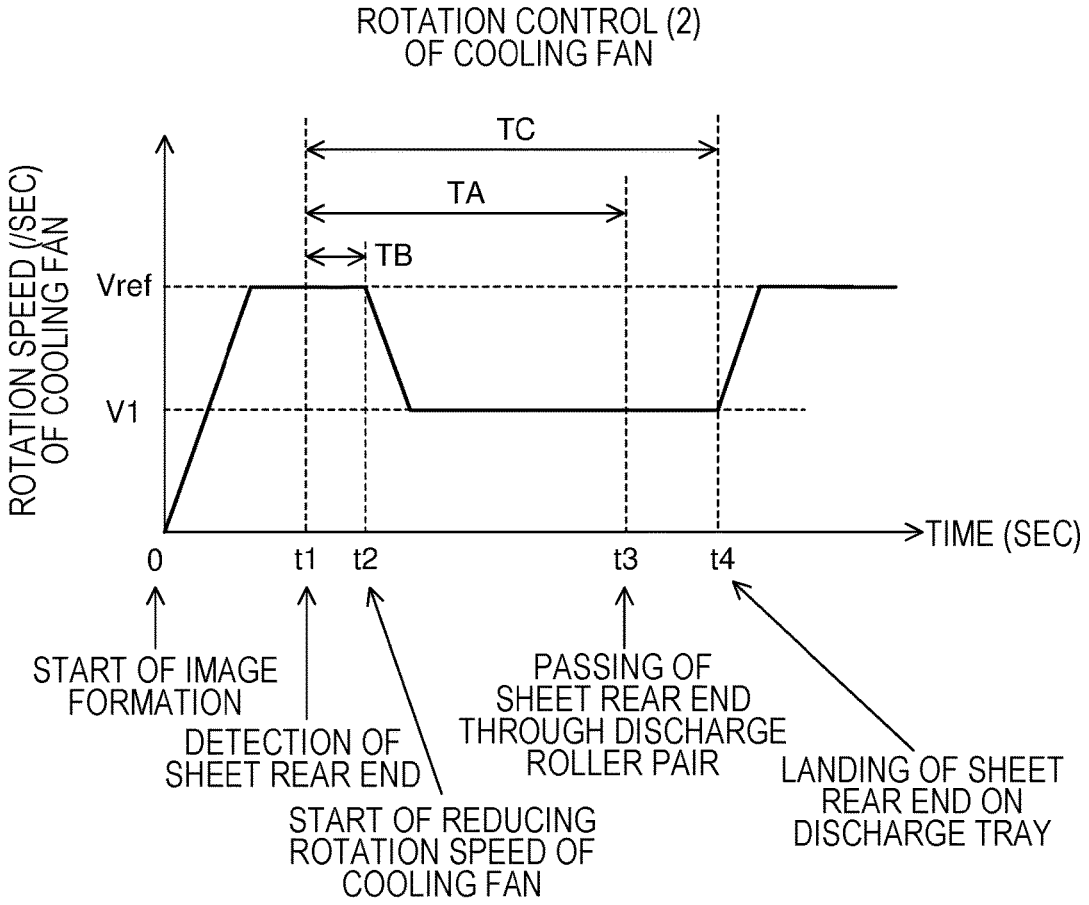
FIG. 11 is a graph showing another example of variations in the rotation speed of the above-described cooling fan.

FIG. 11 is a graph showing another example of variations in the rotation speed of the cooling fan 50*a*. As shown in the figure, within the prescribed period TA, the cooling fan control unit 52 may perform control so that the rotation speed of the cooling fan 50*a* is reduced to half the reference speed Vref. That is, it may be set that V1=(½)Vref where a value of the rotation speed of the cooling fan 50*a* reduced from the reference speed Vref is indicated as V1 (/sec).

Also in this case, just like in the foregoing case, after the rear end Sb of the sheet S has passed through the discharge roller pair 20, the sheet S is affected by air blown from the cooling fan 50*a* to a less degree than in a case where the cooling fan 50*a* rotates at the reference speed Vref. Accordingly, it is possible to suppress the phenomenon in which, before the sheet S lands on the discharge tray 22, the sheet S loses its postural balance due to air blown from the cooling fan 50*a*. As a result, it is possible to reduce alignment failure of the sheets S on the discharge tray 22. Furthermore, thereafter, the above-described rotation speed can be increased back to the reference speed Vref as an original value more swiftly than in a case where the rotation speed of the cooling fan 50*a* is reduced to stop rotation of the cooling fan 50*a* as shown in FIG. 9. Thus, the sheet S discharged on the discharge tray 22 can be cooled swiftly by the cooling fan 50*a* rotating at the above-described reference speed Vref.

Other than the above, also in a case where it is set that V1=(¼)Vref or V1=(¾)Vref, an effect similar to the above-described effect can be obtained. Accordingly, it can be said that the rotation speed V1 may be set to any value lower than the reference speed Vref.

[Rotation Control (3) of Cooling Fan]

Figure 12:
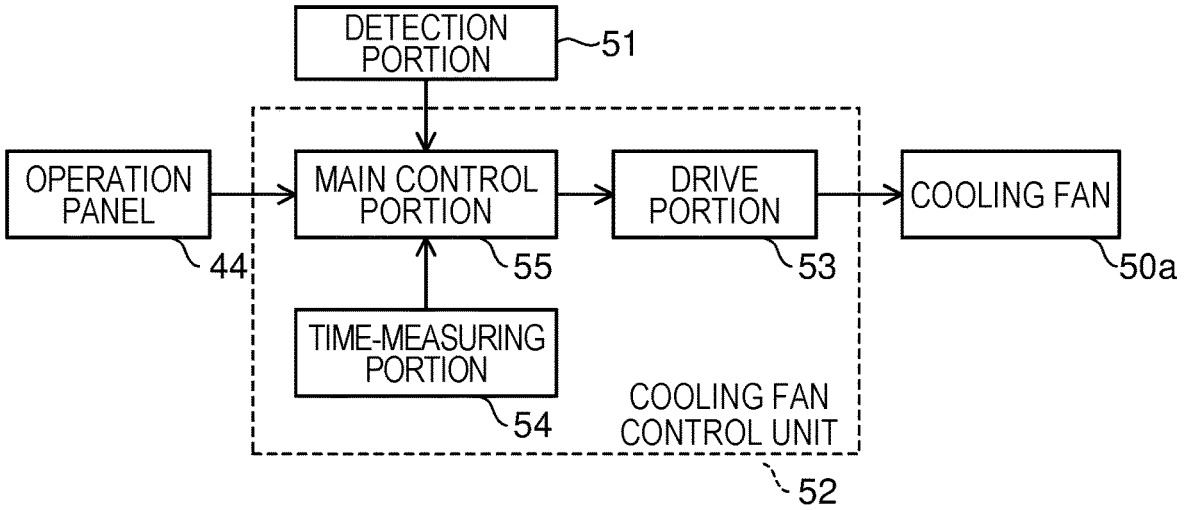
FIG. 12 is a block diagram schematically showing another configuration of the above-described control system.

FIG. 12 is a block diagram schematically showing another configuration of the control system that controls rotation of the cooling fan 50*a* in the image forming apparatus 100 according to this embodiment. The reference speed Vref of the cooling fan 50*a* used at the time of sheet cooling may vary depending on the size of the sheet S set as a printing subject via the operation panel 44 (see FIG. 1).

Figure 13:
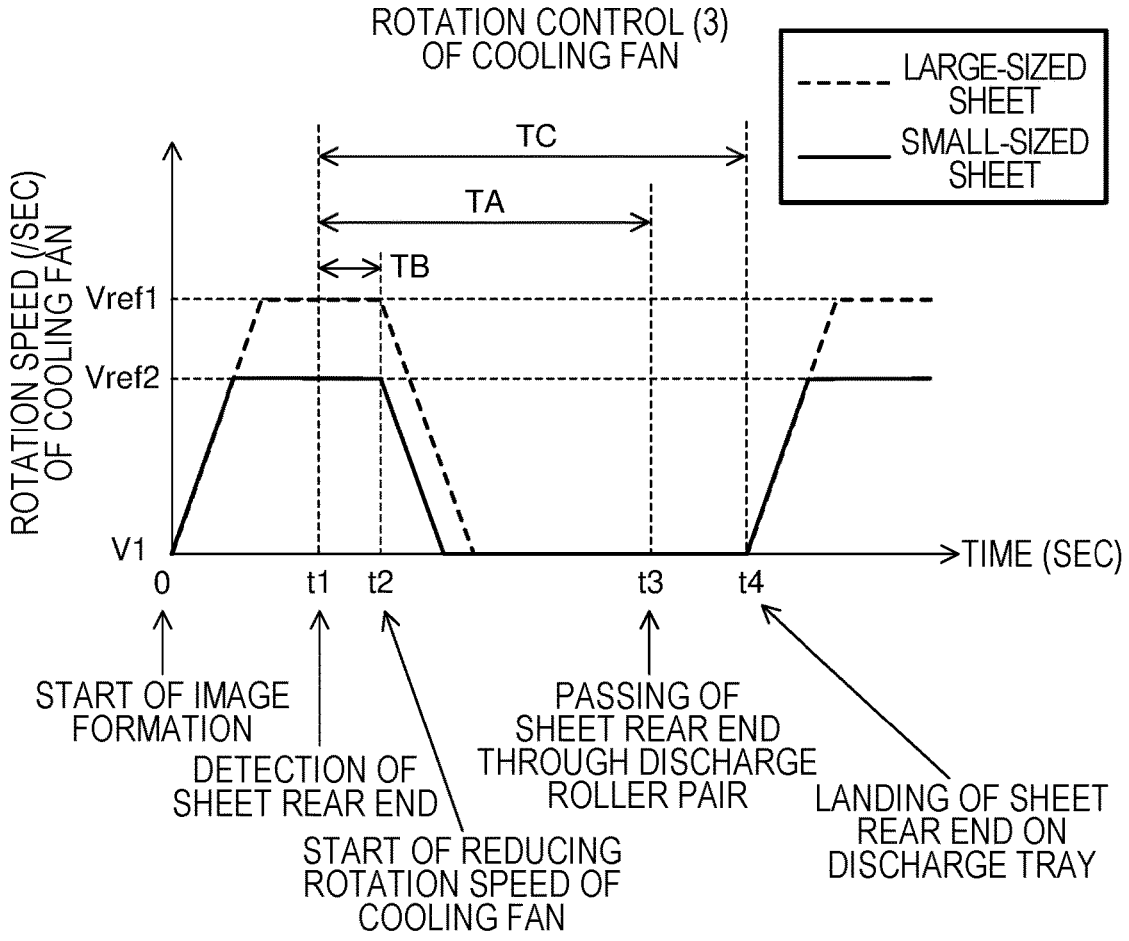
FIG. 13 is a graph showing still another example of variations in the rotation speed of the above-described cooling fan.

FIG. 13 is a graph showing still another example of variations in the rotation speed of the cooling fan 50*a*. As shown in the figure, the cooling fan control unit 52 may perform control so that, in a case of using a large-sized sheet S (for example, of the A3 size (297 mm×420 mm)), the reference speed Vref of the cooling fan 50*a* is set so that Vref=Vref1 (/sec), and in a case of using a small-sized sheet S (for example, of the A4 size (210 mm×297 mm)), the reference speed Vref of the cooling fan 50*a* is set to Vref2 (/sec) smaller than Vref1.

The smaller the size of the sheet S is, the smaller a required volume of air blown from the cooling fan 50*a* to cool the sheet S can be. Conversely, the larger the size of the sheet S is, the larger a required volume of air blown from the cooling fan 50*a* to cool the sheet S is. From this viewpoint, the cooling fan control unit 52 performs control so that the reference speed Vref used at the time of sheet cooling varies depending on the size of the sheet S set via the operation panel 44, and thus the sheet S can be reliably cooled using a volume of air appropriate for the size of the sheet S.

Particularly, the cooling fan control unit 52 performs control so that the smaller the size of the sheet S is, the smaller a value of the reference speed Vref is, and thus the smaller the size of the sheet S is, the smaller a required volume of air to cool the sheet S is, so that it is possible to suppress sticking between the sheets S and image peeling therefrom.

[Rotation Control (4) of Cooling Fan]

Figure 14:
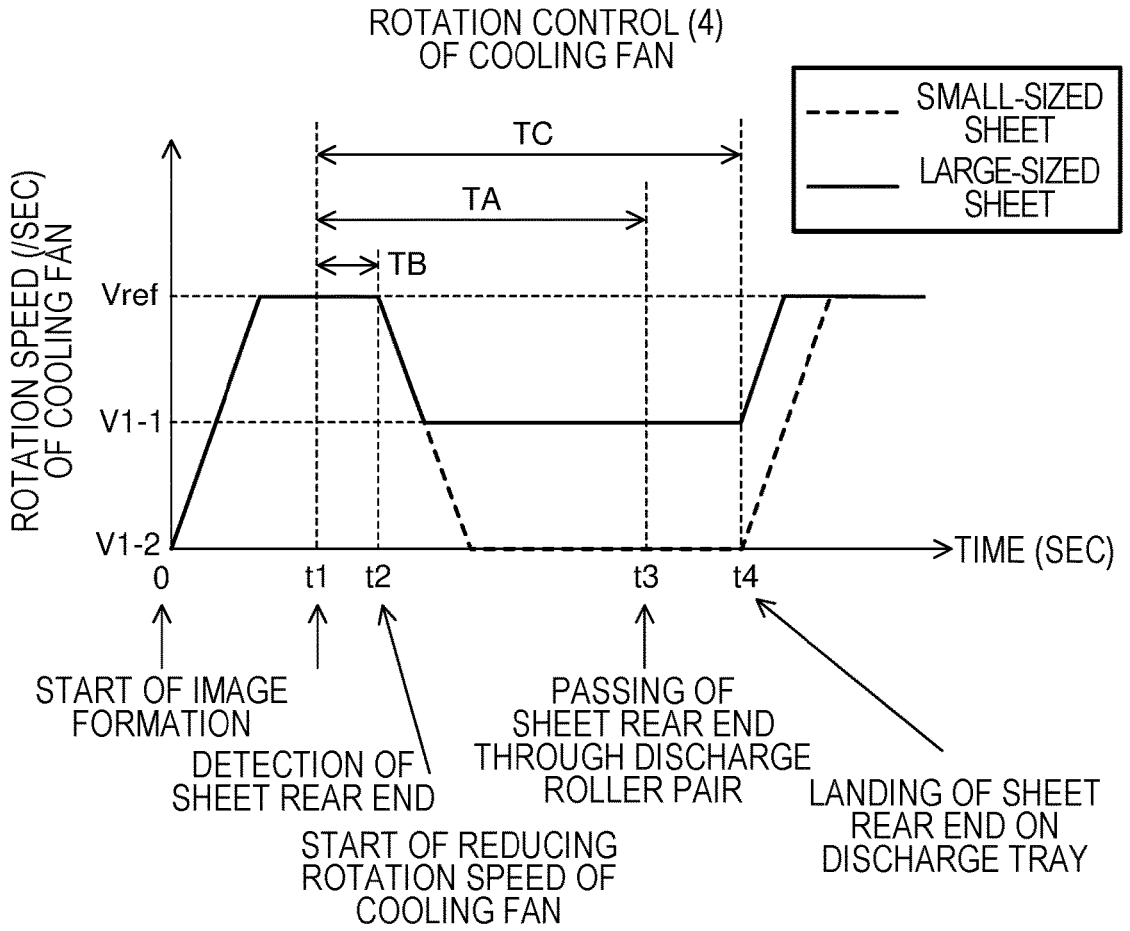
FIG. 14 is a graph showing yet another example of variations in the rotation speed of the above-described cooling fan.

Furthermore, FIG. 14 is a graph showing yet another example of variations in the rotation speed of the cooling fan 50*a*. As shown in the figure, the cooling fan control unit 52 may perform control so that, in a case of using a large-sized sheet S (for example, of the A3 size), the rotation speed of the cooling fan 50*a* is reduced from the reference speed Vref to a speed V1-1 (/sec), and in a case of using a small-sized sheet S (for example, of the A4 size), the rotation speed of the cooling fan 50*a* is reduced from the reference speed Vref to a speed V1-2 (/sec) lower than the speed V1-1.

The smaller the size of the sheet S is, the more decreased the weight of the sheet S is, and thus when such a smaller-sized sheet S is conveyed through the discharge port 21 toward the discharge tray 22, the sheet S is likely to be affected by air blown by the cooling fan 50*a*. Because of this, before the sheet S lands on the discharge tray 22, the sheet S is likely to lose its postural balance due to the air blown thereto, so that the alignment property of the sheets S on the discharge tray 22 is likely to be degraded. Conversely, the larger the size of the sheet S is, the more increased the weight of the sheet S is, and thus when such a larger-sized sheet S is conveyed through the discharge port 21 toward the discharge tray 22, the sheet S is unlikely to be affected by air blown by the cooling fan 50*a*. Therefore, before the sheet S lands on the discharge tray 22, the sheet S is unlikely to lose its postural balance due to the air blown thereto, so that the alignment property of the sheets S on the discharge tray 22 is unlikely to be degraded.

From this viewpoint, the cooling fan control unit 52 performs control so that the rotation speed of the cooling fan 50*a* is reduced from the reference speed Vref by an amount varying depending on the size of the sheet S set via the operation panel 44, and thus a degree to which the sheet S is affected by air blown by the cooling fan 50*a* can be adjusted depending on the size of the sheet S. It is, therefore, possible to load the sheets S of any size on the discharge tray 22 so that an excellent alignment property is achieved.

Particularly, the cooling fan control unit 52 performs control so that the smaller the size of the sheet S is, the more the rotation speed of the cooling fan 50*a* is reduced from the reference speed Vref (V1-1>V1-2), and thus it is possible to effectively reduce a degree to which the sheet S being conveyed through the discharge port 21 toward the discharge tray 22 is affected by air blown by the cooling fan 50*a*. Thus, even when the sheet S is of a small size, it is possible to reliably suppress the phenomenon in which, before the sheet S lands on the discharge tray 22, the sheet S loses its postural balance due to air blown thereto, so that an alignment property of the sheets S on the discharge tray 22 is degraded.

While the foregoing has described an example in which the reference speed Vref of the cooling fan 50*a* is made to vary depending on the size of the sheet S set via the operation panel 44 or the rotation speed thereof is reduced from the reference speed Vref by an amount varying depending on the above-described size, a scheme of setting the size of the sheet S is not limited to setting via the operation panel 44. For example, the size of the sheet S may be set based on an original document size detected in an original document size detection portion (not shown) incorporated in the image reading portion 42 (see FIG. 1 and FIG. 2) and a printing magnification designated via the operation panel 44. Furthermore, in a case where the image forming apparatus 100 is a multi-functional peripheral having a function of a facsimile, the size of the sheet S may be automatically set based on the size of an original document received by the facsimile. Moreover, in a case where the image forming apparatus 100 is connected to a personal computer and functions as a printer, the size of the sheet S may be set via the personal computer.

While this embodiment has described a case where rotation of the cooling fan 50*a* is controlled in a color copy machine, the various types of rotation control of the cooling fan 50*a* according to this embodiment are applicable to various other types of image forming apparatuses such as a monochrome copy machine, a monochrome printer, a color printer, a facsimile, and a multi-functional peripheral.

INDUSTRIAL APPLICABILITY

The present invention is usable in an image forming apparatus such as a color copy machine.

The invention claimed is:

1. An image forming apparatus, comprising:

a fixing device that fixes a toner image on a sheet;

a branch portion that guides the sheet on which the toner image has been fixed in the fixing device into either a first conveyance path or a second conveyance path;

a discharge roller pair that discharges the sheet guided into the first conveyance path to a discharge tray via a discharge port;

a switchback roller pair that makes the sheet guided into the second conveyance path project into a space over the discharge tray via an opening and that then switches the sheet back to a reverse conveyance path;

a cooling fan that is situated between the discharge port and the opening to blow air obliquely downward and that cools the sheet discharged on the discharge tray by blowing air to the sheet;

a detection portion that detects a rear end of the sheet being conveyed from the fixing device toward the discharge port; and a cooling fan control unit that, based on an amount of time that has elapsed from a point in time of detection of the rear end of the sheet by the detection portion, controls rotation of the cooling fan, wherein the cooling fan control unit performs control so that, within a prescribed period from the point in time of detection of the rear end to when the rear end of the sheet passes through the discharge roller pair, a rotation speed of the cooling fan is reduced to a value lower than a reference speed used at a time of cooling the sheet.

2. The image forming apparatus according to claim 1, wherein a lapse of a prescribed amount of time from the point in time of detection of the rear end, the cooling fan control unit performs control so that the rotation speed of the cooling fan is reduced to the value lower than the reference speed.

3. The image forming apparatus according to claim 1, wherein within the prescribed period, the cooling fan control nit controls the cooling fan to stop rotating.

4. The image forming apparatus according to claim 1, wherein within the prescribed period, the cooling fan control unit performs control so that the rotation speed of the cooling fan is reduced to half the reference speed.

5. The image forming apparatus according to claim 1, wherein the prescribed period is a duration determined based on a predetermined conveyance distance of the sheet from a position at which the rear end of the sheet is detected by the detection portion to a position of the discharge roller pair and a discharge speed of the sheet discharged by the discharge roller pair.

6. The image forming apparatus according to claim 1, wherein after a lapse of a predetermined discharge period from the point in time of detection of the rear end to when the rear end of the sheet lands on the discharge tray, the cooling fan control unit performs control so that the rotation speed of the cooling fan is increased back to the reference speed.

7. The image forming apparatus according to claim 1, wherein the cooling fan control unit performs control so that the reference speed varies depending on a size of the sheet that is set.

8. The image forming apparatus according to claim 7, wherein the cooling fan control unit performs control so that the smaller the size of the sheet is, the smaller a value of the reference speed is.

9. The image forming apparatus according to claim 1, wherein the cooling fan control unit performs control so that the rotation speed of the cooling fan is reduced from the reference speed by an amount varying depending on a size of the sheet that is set.

10. The image forming apparatus according to claim 9, wherein the cooling fan control unit performs control so that the smaller the size of the sheet is, the more the rotation speed of the cooling fan is reduced from the reference speed.

* * * * *